US012071817B2

(12) United States Patent
Case

(10) Patent No.: US 12,071,817 B2
(45) Date of Patent: Aug. 27, 2024

(54) DRILL BIT

(71) Applicant: Ulterra Drilling Technologies, L.P., Fort Worth, TX (US)

(72) Inventor: Spencer Case, Fort Worth, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 17/649,741

(22) Filed: Feb. 2, 2022

(65) Prior Publication Data

US 2022/0243538 A1 Aug. 4, 2022

Related U.S. Application Data

(60) Provisional application No. 63/144,664, filed on Feb. 2, 2021.

(51) Int. Cl.
*E21B 10/567* (2006.01)

(52) U.S. Cl.
CPC ..... *E21B 10/567* (2013.01)

(58) Field of Classification Search
CPC ..... E21B 10/43; E21B 10/567; E21B 10/56; E21B 10/42; E21B 10/04
See application file for complete search history.

(56) References Cited

U.S. PATENT DOCUMENTS 6,834,733 B1 * 12/2004 Maouche ..... E21B 10/55 175/429
9,016,407 B2 * 4/2015 Durairajan ..... E21B 10/43 175/398
10,731,421 B2 8/2020 Casad
10,774,595 B2 * 9/2020 Russell ..... E21B 10/08
2007/0261890 A1 11/2007 Cisneros
2008/0135297 A1 * 6/2008 Gavia ..... E21B 10/43 175/391
2015/0345228 A1 * 12/2015 Williams ..... E21B 10/26 175/405.1
2020/0048968 A1 * 2/2020 Casad ..... E21B 10/55
2020/0056430 A1 2/2020 Casad et al.

FOREIGN PATENT DOCUMENTS

CN 105781426 7/2016

OTHER PUBLICATIONS

International Application No. PCT/US2022/014901 , International Search Report and Written Opinion, Mailed on Apr. 5, 2022, 14 pages.
International Application No. PCT/US2022/014901, "International Preliminary Report on Patentability", Aug. 17, 2023, 10 pages.

* cited by examiner

*Primary Examiner* — Caroline N Butcher
(74) *Attorney, Agent, or Firm* — Kilpatrick Townsend & Stockton LLP

(57) ABSTRACT

Downhole tools with fixed cutters for engaging subterranean formations, removing rock, and drilling wellbores may include drill bits (e.g., polycrystalline-diamond compact bits) adapted to smooth torque and to minimize vibration during operation. The drill bits may have alternately arranged or designed blades. In some cases, one or more blades of the drill bit may have a wave-shaped blade. In some cases, the drill bit may have multiple blades with patterns that differ from each other in shape or orientation.

20 Claims, 7 Drawing Sheets

DRILL BIT

CROSS-REFERENCE TO RELATED APPLICATIONS

This application claims the benefit of U.S. Provisional Application Ser. No. 63/144,664, filed on Feb. 2, 2021, which is hereby expressly incorporated by reference in its entirety for all purposes.

FIELD

The present disclosure relates generally to the field of downhole tools with fixed cutters for engaging subterranean formations, removing rock, and drilling wellbores. More specifically, the present disclosure relates to drill bits (e.g., polycrystalline-diamond compact bits) adapted to smooth torque and to minimize vibration during operation.

BACKGROUND

Polycrystalline-diamond compact (PDC) bits are a type of rotary drill bit used for boring through subterranean formations, e.g., when drilling wellbores for oil and/or natural gas as well as for mining and various additional applications. As a PDC bit is rotated, discrete cutting elements affixed to the face of the bit engage with the rock walls at the bottom of the well, scraping or shearing the formation. PDC bits use cutting elements, referred to as "cutters," each having a cutting surface or wear surface comprised of a polycrystalline diamond, hence the designation "PDC bit." Each PDC cutter is a discrete piece, separate from the drill bit, and is fabricated by bonding a layer of polycrystalline diamond, sometimes called a crown or diamond table, to a substrate. Each PDC cutter of a rotary drag bit may be positioned and oriented on a face of the drag bit so that at least a portion of the cutting surface engages the subterranean formation as the bit is being rotated. The PDC cutters are spaced apart on an exterior cutting surface or face of the body of a drill bit. The PDC cutters are typically arrayed along each of several blades, which are raised ridges extending radially generally from the central axis of the bit toward the periphery of the face. The PDC cutters along each blade present a predetermined cutting profile to the subterranean formation, shearing the formation as the bit rotates.

In a typical drilling operation, the drill bit is rotated about a central axis while being advanced into the subterranean formation, and the PDC cutters further the borehole by scraping, shearing, crushing, or otherwise failing the rock walls at the bottom of the well. During operation, however, the drill bit is susceptible to vibration. This vibration may be axial, lateral, or torsional (or some combination of the three). Excessive levels of these vibrations can lead to premature damage of the cutting structure, which can diminish performance. Vibration may be caused by uneven or inconsistent torque on the drill bit. For example, certain subterranean formations, such as those having brittle or inconsistent rock strength (e.g., the Permian Basin, limestones, dolomites, and carbonates), may induce large torque spikes due to the variable force needed to advance a borehole. These torque spikes contribute to vibration of the drill bit.

Vibration of the drill bit during operation contributes to premature bit or drill string failure as well as reduced rates of penetration. PDC, although hard and abrasion resistant, tends to be brittle. The vibration of the drill bit imposes stress on the bit body, which can result in the initiation and growth of damage to the drill bit. When this happens, drilling operations may be unnecessarily slowed or even forced to stop altogether to allow for the drill bit to be replaced.

Thus, the need exists for drill bits that can operate with minimized susceptibility to vibration. In particular, the need exists for drill bits that are adapted to drill through subterranean wellbores at smooth torque (e.g., with minimized torque spikes).

SUMMARY

In one aspect, the present disclosure describes a drill bit to advance a borehole, comprising a bit body comprising a central axis about which the drill bit is intended to rotate and a first blade extending from the face; and a plurality polycrystalline diamond compact ("PDC") cutters on the first blade. In this aspect, the first blade of the drill bit has a first waveform pattern defined from about the central axis to an outer edge of the bit body. The first waveform pattern optionally has a sinusoidal shape. In some cases, the bit body further comprises a second blade extending from the face, and the first blade and the second blade are separated by a channel. In some aspects, the first blade and the second blade are rotationally adjacent. In some cases, the second blade has a linear pattern defined from about the central axis to the outer edge. In other cases, the second blade has a curved pattern defined from about the central axis to the outer edge. In still other cases, the second blade has a second waveform pattern defined from about the central axis to the outer edge. Optionally, the first waveform pattern and the second waveform pattern have a differing shape, amplitude, frequency, and/or phase. In some aspects, the first waveform pattern and the second waveform pattern are at least partially out of phase. In some cases, for example, the first waveform pattern and the second waveform pattern exhibit a phase shift of from 0° to 180°.

In another aspect, the present disclosure describes a drill bit to advance a borehole, comprising a bit body having a central axis about which the drill bit is intended to rotate and a face on which is defined a plurality of blades the face and separated by channels between the blades; and a plurality of PDC cutters on the plurality of blades. In this aspect, the pattern of each blade differs from the other blades in shape or orientation. In some cases, a first blade of the plurality of blades has a pattern selected from the group consisting of a linear pattern, a curved pattern, and a waveform pattern. In some cases, a second blade of the plurality of blades has a pattern selected from the group consisting of a linear pattern, a curved pattern, and a waveform pattern, and the first blade and the second blade have differing patterns. Optionally, the first blade may have a first waveform pattern defined from the central axis to an outer edge of the bit body. In some aspects, a second blade of the plurality of blades has a second waveform pattern defined from a non-central axis of the bit body to the outer edge. In some cases, a second blade of the plurality of blades has a second waveform pattern defined from the central axis of the bit body to the outer edge, and the first waveform pattern and the second waveform pattern have a differing shape, amplitude, frequency, and/or phase. In some cases, the first blade has a linear pattern defined from the central axis to an outer edge of the bit body, and the second blade has a linear pattern defined from a non-central axis of the bit body to the outer edge. In other cases, the first blade has a linear pattern defined from the central axis to an outer edge of the bit body, and the second blade has a curved pattern defined from the central axis to the outer edge. In still other cases, the first blade has a curved pattern defined from the central axis to an outer edge of the bit body, and the second blade has a curved pattern defined from a non-central axis to the outer edge.

In another aspect, the present disclosure describes a drill bit to advance a borehole, comprising a bit body having a central axis about which the drill bit is intended to rotate and a face; a first blade disposed at least in part on the face; a second blade disposed at least in part on the face, the first blade and the second blade being separated by a first channel; and a plurality of PDC cutters on each of the first blade and the second blade. In this aspect, the first blade extends from the central axis to an outer edge of the bit body, and the second blade extend from a first non-central axis to the outer edge. In some cases, the first blade has a pattern selected from the group consisting of a linear pattern, a curved pattern, and a waveform pattern. For example, the first blade may have a linear pattern. In some cases, the second blade has a pattern selected from the group consisting of a linear pattern, a curved pattern, and a waveform pattern. For example, the second blade may have a linear pattern. In some aspects, the drill bit further comprises a third blade disposed at least in part on the face and extending from a second non-central axis to the outer edge. In some cases, the third blade has a pattern selected from the group consisting of a linear pattern, a curved pattern, and a waveform pattern. For example, the third blade may have a linear pattern.

In another aspect, the present disclosure describes a drill bit comprising a bit body having a central axis about which the drill bit is intended to rotate, a first blade, and second blade, the first blade and the second blade being separated by a channel; a first plurality of PDC cutters supported by the first blade; and a second plurality of PDC cutters supported by the second blade. In this embodiment, the first plurality of PDC cutters is aligned along a first line extending from a first axis of the bit body, and the second plurality of PDC cutters is aligned along a second line extending from a second axis of the bit body. In some cases, the first line is linear, curved along an arc, or waveform. In some cases, the second line is linear, curved along an arc, or waveform. In some aspects, the first line and the second line are differently shaped or oriented. The first axis and the second axis may be a central axis about which the drill bit is intended to rotate, and the first line and the second line may have a differing shape. In some cases, the first axis is the central axis, the second axis is a non-central axis, and the first line and the second line are superimposable. The first axis is optionally parallel to the second axis.

In another aspect, the present disclosure describes a drill bit comprising a bit body having a first blade and second blade, the first blade and the second blade being separated by a channel; a first plurality of PDC cutters supported by the first blade, the first plurality of PDC cutters being aligned along a first line; and a second plurality of PDC cutters supported by the second blade, the second plurality of PDC cutters being aligned along a second lin. In this aspect, the first line has a positive offset from the central axis, and the second line has a negative offset.

In another aspect, the present disclosure describes a method of advancing a borehole through rock with a drill bit. In this aspect, the drill bit comprises a bit body having a central axis about which the drill bit is intended to rotate and a face on which is defined a plurality of blades extending from the face and separated by channels between the blades, and a plurality of PDC cutters on the plurality of blades. The pattern of each blade from the other blades in shape or orientation. The method comprises rotating the drill bit about the central axis within the borehole to cause the plurality of PDC cutters to shear the rock.

BRIEF DESCRIPTION OF THE DRAWINGS

The disclosure is described in detail below with reference to the appended drawings, wherein like numerals designate similar parts.

DETAILED DESCRIPTION

Figure 1:
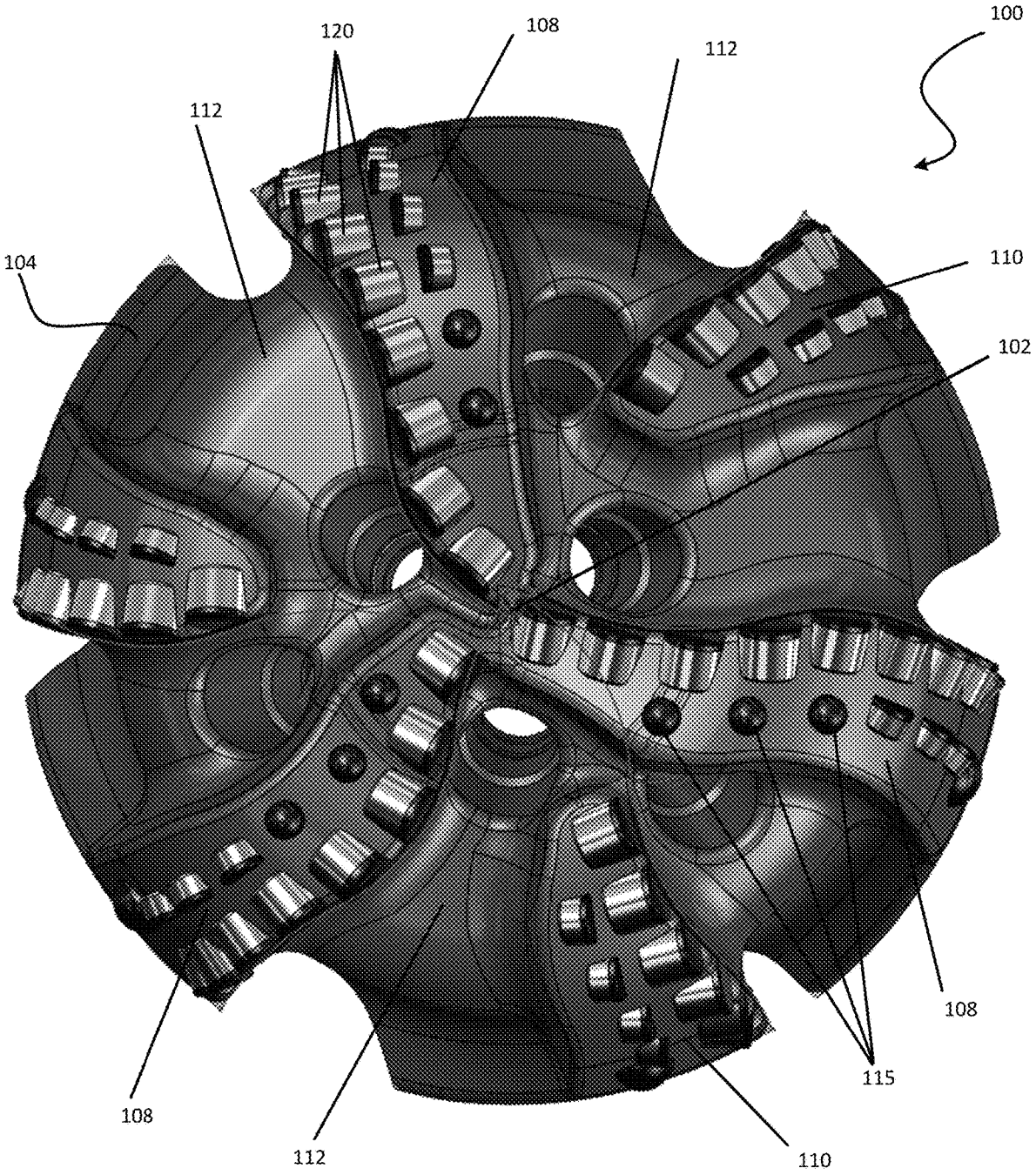
FIG. 1 is a face-on view of a drill bit in accordance according with various embodiments of the present disclosure.

The present disclosure provides drill bits that are adapted to operate with minimized susceptibility to vibration. In particular, the drill bits described herein include one or more blades that have been designed or modified to mitigate torque spikes.

Conventional drilling operations utilize drill bits (e.g., PDC bits) that have multiple blades, each of which have the same or generally similar shapes and orientations. These conventional drill bits have a plurality of blades which typically extend from the face of the bit body and follow a line or curve from about the center (e.g., the central axis) to an outer edge of the bit body. The blades typically have a substantially similar shape and orientation. For example conventional PDC bit may comprise three blades, each with the same curved shape and each having an identical offset from the central axis of the bit body. The conventional drill bit may comprise both primary blades and secondary blades, which may vary in terms of size or shape. In this aspect, the secondary blades are typically shorter than the primary blade and do not extend from a location near the central axis. Despite the differences between the primary and secondary blades, each of the primary blades optionally are substantially identical to one another, and each of the secondary blades are optionally substantially identical to another.

The design of conventional drill bits creates imperfections in a subterranean formation. These imperfections may appear, for example, as a series of steps or ridges on the face of the generally conical or round borehole. These imperfections cause the drill bit and the drill string to vibrate, exposing the drill bit, particularly the cutters of the drill bit, to damage.

In contrast, the present disclosure provides drill bits with alternately arranged or designed blades. In some embodiments, the drill bit of the present disclosure comprises a blade that has a waveform pattern defined from about the central axis to an outer edge of the bit body. In some cases, the drill bit optionally further comprises additional blades having differing shapes or orientations. In some embodiments, the present disclosure provides a drill bit comprising a plurality of blades, wherein the pattern of each blade differs from the pattern of another of the blades in shape or orientation. In some embodiments, the drill bit comprises PDC cutters that are each supported on a first blade and/or second blade, wherein the blades extend from varying axes of the bit body. In some embodiments, each of the PDC cutters of the drill bit are supported on a first blade and/or a second blade, which have a positive and a negative offset, respectively.

In each embodiment described herein, the drill bit is less susceptible to the effects of uneven or inconsistent torque. This is due to a novel design and orientation in the blades of the drill. In particular, the blades of the bit have been designed to more gradually meet the imperfections and/or inconsistencies in the subterranean formation. As noted above, imperfections and inconsistencies in the rock cause the drill bit to vibrate during operation. This is due, in part, to the conventional design of drill bit blades. Typically, a drill bit is designed with blades that have the same or substantially similar shapes. As a result, the cutters at a given radial distance from the central axis of the drill bit are generally evenly spaced relative to rotation. When the conventional drill bit is rotated in the subterranean formation, the time lag between when a cutter on one blade and the radially corresponding cutter of an adjacent blade engage the rock wall is the same for all cutter pairs between the two blades. Said another way, the cutters periodically engage imperfections and inconsistencies in the rock, which may jolt the drill bit and cause vibration.

In the presently described drill bits, however, the blades are designed with distinct shapes or orientations. This design changing shape or orientation of the blades allows each individual cutter to engage the imperfections incrementally. Unlike the conventional cutters, the blades are designed such that the cutters at a given radial distance from the central axis of the drill bit are not evenly spaced relative to rotation. The time lag between when a cutter on one blade and the radially corresponding cutter of an adjacent blade engage the rock wall is not the same for all cutter pairs between the two blades. As a result, an imperfection or inconsistency at a given position is engaged non-periodically by the cutters. As a result, the drill bits of the present disclosure can operate with minimized susceptibility to vibration. In particular, the novel drill bits can drill through subterranean wellbores at smooth torque (e.g., minimizing torque spikes).

Drill Bit

The present disclosure relates to a drill bit structurally modified to smooth torque and minimize vibration of the drill bit (and the drill string) during operation. In particular, the present disclosure relates to PDC drill bits having at least one blade with a modified shape and/or orientation. In some embodiments, the drill bit comprises a (first) blade having a (first) waveform pattern defined from about the central axis to an outer edge of the bit body. In some embodiments, the drill bit comprises a plurality of blades, the pattern of each blade differing from the other blades in shape or orientation. Varying the shape of the blades relative to other blades, as described herein, smooths the torque on the drill bit during operation.

The drill bits of the present disclosure comprise a bit body, which has a central axis about which the drill bit is intended to rotate. The bit body comprises one or more blades, which extend from the face of the bit body. The blades may extend from the central axis and/or a point near the central axis to the outer edge of the bit body. The shape and variation of the blade or blades may vary, as detailed below. Where the drill bit comprises a plurality of blades, the blades are separated by one or more channels. The drill bit also comprises a plurality of PDC cutters, which are positioned and/or arranged on the blade or blades.

FIG. 1 illustrates an embodiment of the drill bit according the present disclosure. In particular, FIG. 1 illustrates a drill bit 100 structurally adapted to smooth torque. Drill bit 100 is intended to be a representative example of drill bits, e.g., PDC drag bits, for drilling of subterranean formations. Drill bit 100 is designed structurally and mechanically to be rotated around its central axis 102. As shown, drill bit 100 comprises a bit body 104. Bit body 104 is not limited to any particular material. In some embodiments, bit body 104 is made from an abrasion-resistant composite material or "matrix" comprising, for example, powdered tungsten carbide cemented by metal binder.

As shown in FIG. 1, bit body 104 is disposed radially around central axis 102, which bit body 104 is intended to rotate about during the drilling process. In particular, the perspective of FIG. 1 illustrates the face of bit body 104, which is intended to engage a bottom end of a well bore being drilled. In the embodiment shown, the face substantially lies in a plane perpendicular to central axis 102 of drill bit 100. The drill bit 100 further includes a plurality of primary blades 108 formed in bit body 104, extending from the face. In the embodiment shown in FIG. 1, each of the plurality of primary blades 108 has a waveform pattern that are out of phase from the other primary blades 108, as described in detail below. In addition, as shown, drill bit 100 may include secondary blades 110, which are positioned among the plurality of primary blades 108, such as between two adjacent primary blades 108. Whereas the plurality of primary blades 108 extend from a point generally near the central axis 102 of bit body 104 to the outer edge of bit body 104, the secondary blades 110 begin a radial distance from central axis 102 and extend to the outer edge of bit body 104. Channels 112 are formed between each of the plurality of blades 108 and the secondary blades 110. In other embodiments, the bit may include primary blades but no secondary blade, or secondary blades and no primary blade.

In drill bit 100 shown in FIG. 1, a plurality of cutters 120 are placed along the leading edge of primary blades 108 and/or secondary blades 110. The working surfaces of cutters 120 are facing generally in the rotationally forward direction for shearing the subterranean formations when drill bit 100 is rotated about its central axis 102. In some embodiments, each cutter 120 may be approximately aligned with the leading edge of the respective blade. In other embodiments, a side rake of one of more of the cutters 120 may be adjusted such that the respective cutter 120 is not aligned with the leading edge of the blade. For example, the side rake of one or more of the cutters 120 such that less than about 0.060 inches, less than about 0.050 inches, less than about 0.040 inches, less than about 0.030 inches, less than about 0.020 inches, less than about 0.010 inches, or less of the cutter pocket is exposed. The side rake may be adjusted in any embodiment, however side rake adjustments may be particularly useful in blades whose waveforms have particularly high amplitudes, as such waveforms are more likely to expose larger portions of the cutter pocket without such side rake adjustments. Reducing the exposure of the cutter pocket may help prevent cuttings from lodging within the exposed cutter pocket. In some embodiments, one or more of blades 108 may comprise one or more rows of cutters 120 disposed thereon. For example, the drill bit may include a first row of PDC cutters and a second row of PDC cutters mounted on one or more of the blades. In one embodiment, the first row of PDC cutters may be primary cutters, and the second row of PDC cutters may be secondary or backup cutters. Furthermore, the primary cutters may be single set or a plural set (e.g., multiple rows of cutters). In addition, drill bit 100 may include several load bearing elements 115, positioned behind the PDC cutters 120.

Figure 1A:
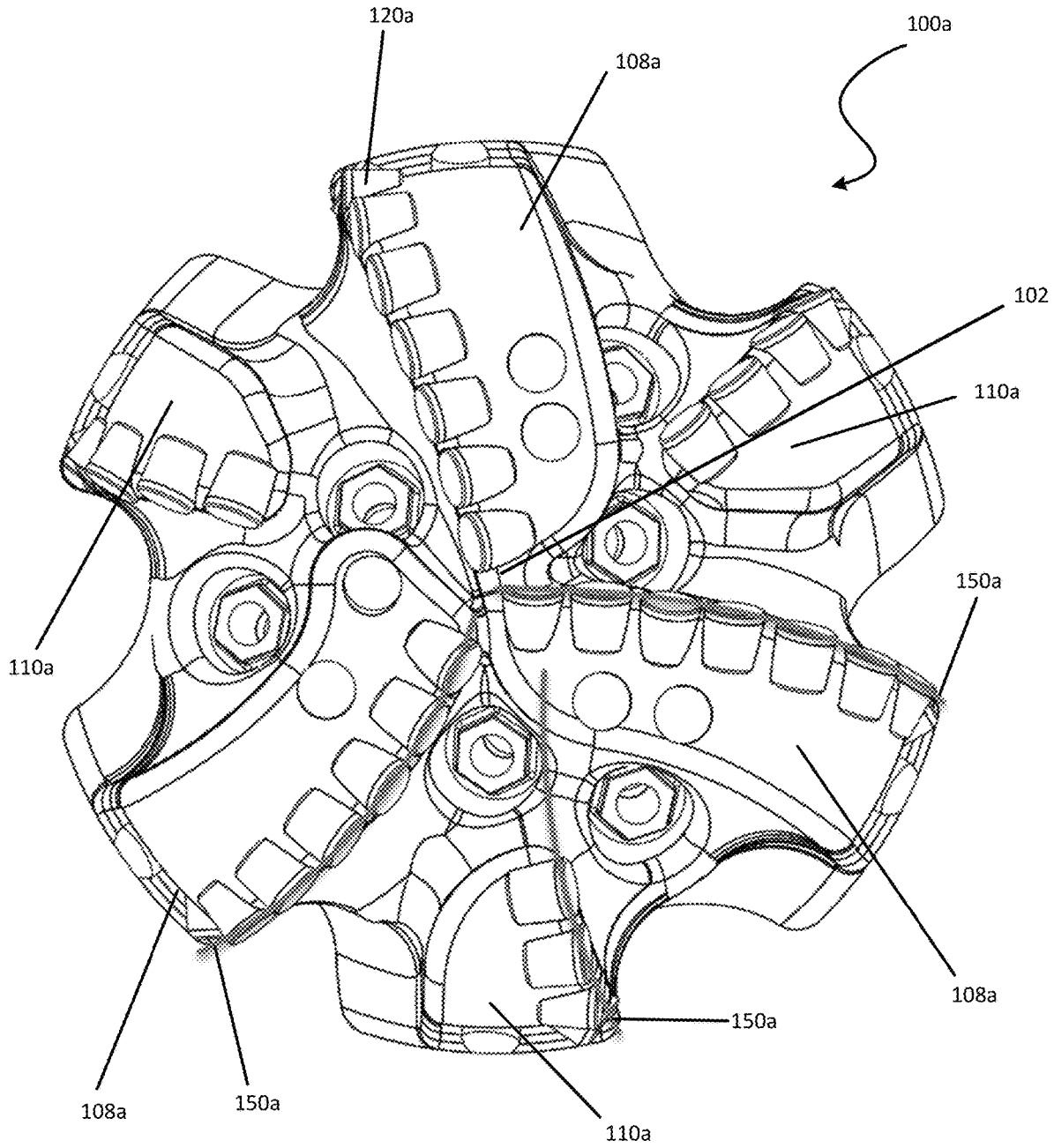
FIG. 1A is a face-on view of a drill bit in accordance according with various embodiments of the present disclosure.

While shown in FIG. 1 with the waveform pattern on each primary blade including both concave and convex regions, it will be appreciated that in some embodiments, the waveform pattern of a primary blade and/or secondary blade may include only a single concave region or a single convex region. For example, as illustrated in FIG. 1A, drill bit 100*a* may include a number of primary blades 108*a* and a number of secondary blades 110*a*, with at least some of the blades including at least one row of cutters 120*a*. One or more of the primary blades 108*a* and/or the secondary blades 110*a* may include a waveform pattern that defines a shape of the leading edge of the respective blade. As illustrated, the waveform pattern on each blade includes only a single concave portion or a single convex portion as illustrated by the lines 150*a*. For example, as illustrated, one or more of the primary blades 108*a* may include only a convex portion of a waveform pattern, while one or more of the secondary blades 110*a* may include only a concave portion of a waveform pattern. It will be appreciated that the primary blades 108*a* may have concave portions and secondary blades 110*a* may have convex portions in other embodiments. The shape of the waveform of rotationally adjacent blades may alternate in some embodiments. For example, where a secondary blade 110*a* is disposed between adjacent primary blades 108*a* (such as illustrated in FIG. 1A), adjacent blades may alternate between having convex and concave waveform portions.

By utilizing blades with waveform patterns as described in relation to FIGS. 1 and 1A, the time lag between when a cutter on one blade and the radially corresponding cutter of an adjacent blade engage the rock wall is not the same for all cutter pairs between the two blades. As a result, an imperfection or inconsistency at a given position is engaged non-periodically by the cutters. As a result, the drill bits of the present disclosure can operate with minimized susceptibility to vibration. In particular, the novel drill bits can drill through subterranean wellbores at smooth torque (e.g., minimizing torque spikes).

Figure 2:
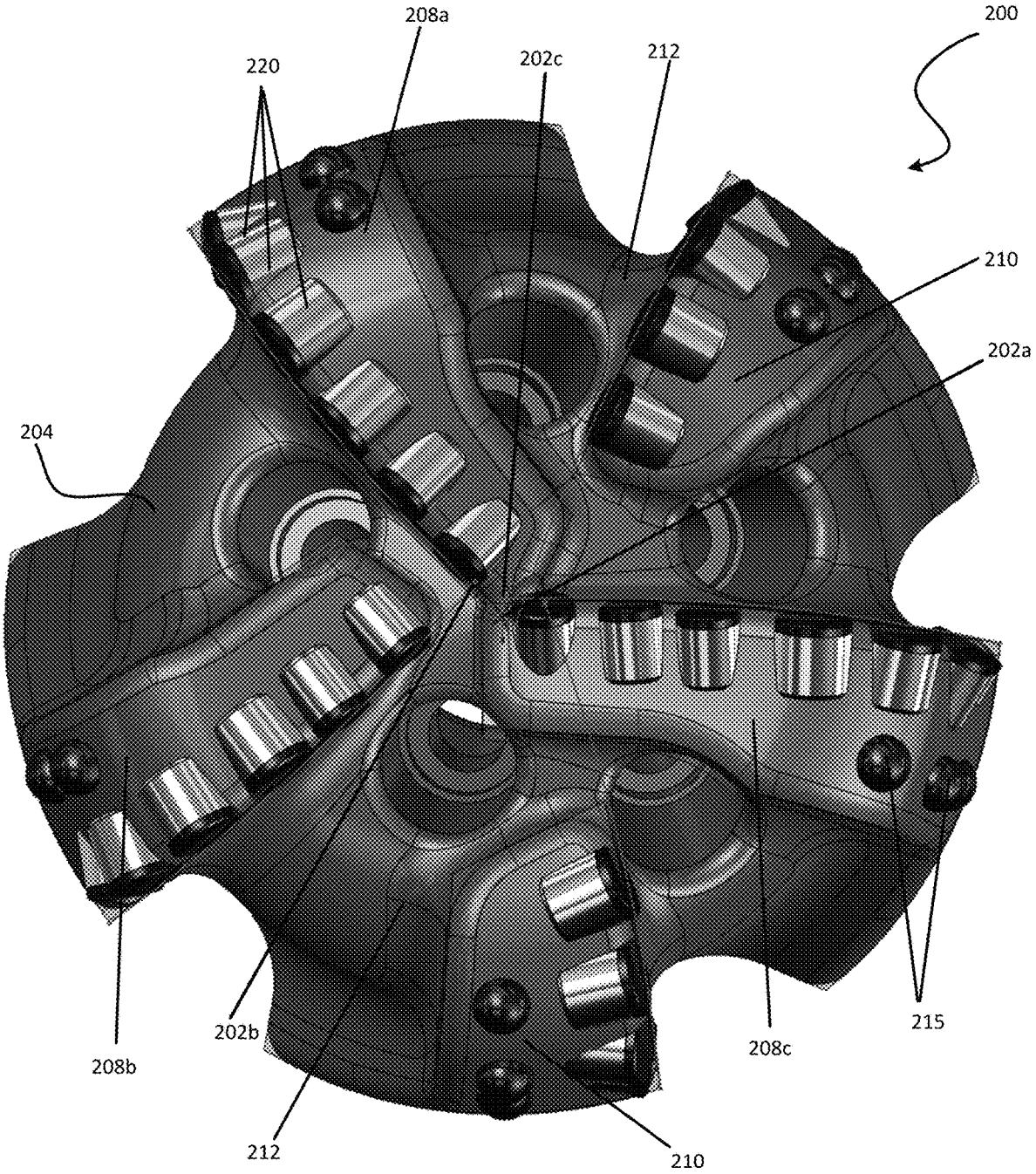
FIG. 2 is a face-on view of a drill bit in accordance according with various embodiments of the present disclosure.

FIG. 2 illustrates another embodiment of the drill bit according the present disclosure. Drill bit 200 shown in FIG. 2 is also structurally adapted to smooth torque. Drill bit 200 is designed structurally and mechanically to be rotated around its central axis 202*a*. As with the embodiments shown in FIGS. 1 and 1A, drill bit 200 of FIG. 2 comprises a body 204 disposed radially around central axis 202*a*. The perspective of FIG. 2 similarly illustrates the face of bit body 204, which is intended to engage a bottom end of the well bore being drilled and which substantially lies in a plane perpendicular to central axis 202*a*.

Drill bit 200 shown in FIG. 2 differs from that of FIGS. 1 and 1A in the shape and orientation of its blades 208*a*, 208*b*, 208*c*, which are formed in bit body 204 and extend from the face. In the embodiment shown in FIG. 2, each of the plurality of blades 208*a*, 208*b*, 208*c* has a linear pattern, but each differs in orientation. In particular, the blades 208*a*, 208*b*, 208*c* of the drill bit 200 may have differing offsets from the central axis, as described in detail below. For example, as illustrated, a first blade 208*a* has no offset and extends from central axis 202*a* to an outer edge of bit body 204. A second blade 208*b* has a negative offset and extends from non-central axis 202*b* to an outer edge of bit body 204. A third blade 208*c* has a positive offset and extends from central axis 202*c* to an outer edge of bit body 204. In addition, drill bit 200 includes secondary blades 210. Channels 212 are formed between each of the plurality of blades 208*a*, 208*b*, 208*c* and secondary blades 210. Notably, various combinations of blades may be employed together, and the disclosure is not limited to the specific configurations shown in the figures.

As with the drill bits of FIGS. 1 and 1A, the drill bit 200 shown in FIG. 2 includes a plurality of cutters 220, placed along the leading edge of blades 208*a*, 208*b*, 208*c* and of secondary blades 210. The drill bit 200 may similarly comprise one or more rows of cutters 220 disposed on one or more blades. In addition, drill bit 200 may include several load bearing elements 215, positioned behind the PDC cutters 220.

Figure 3:
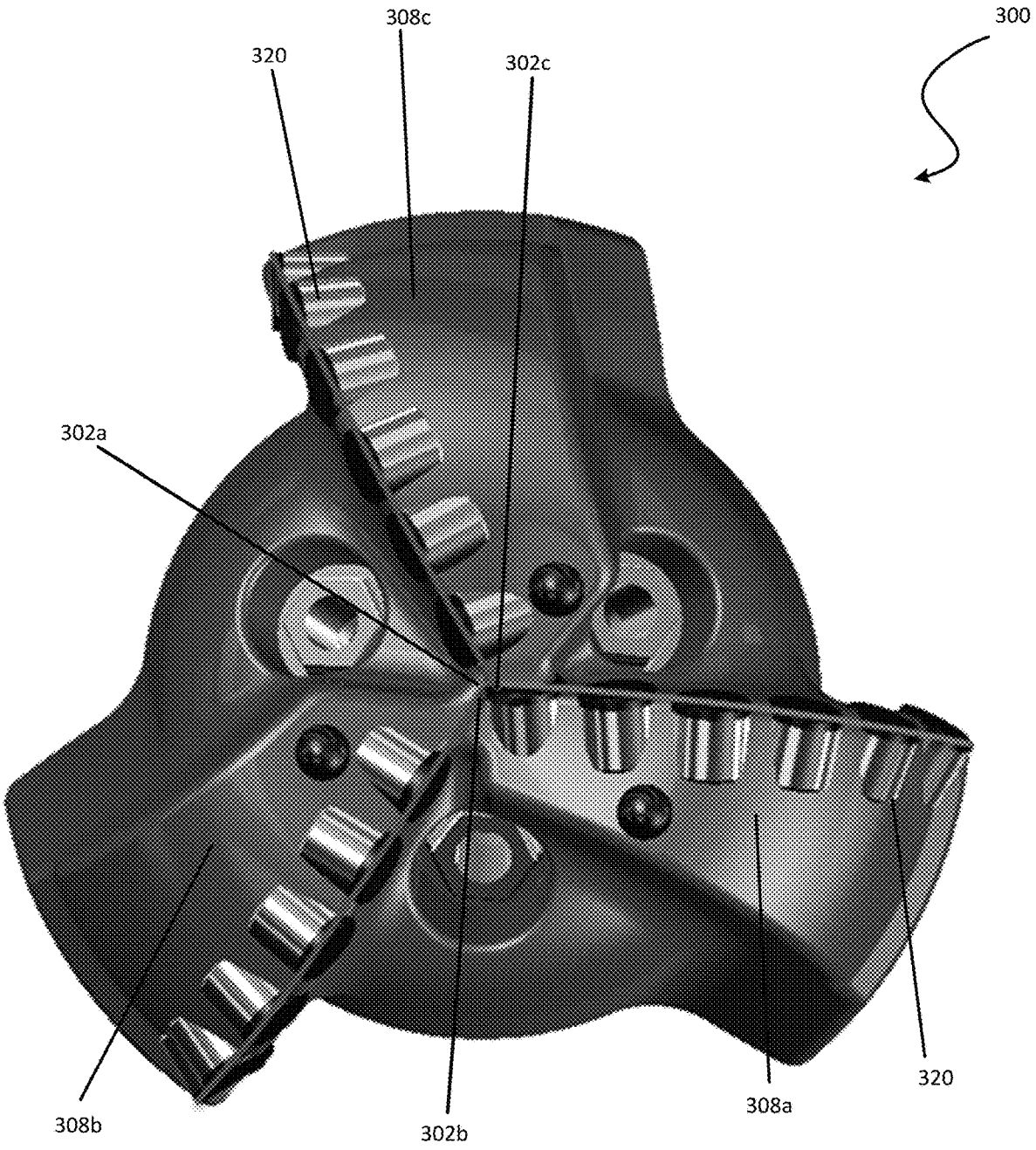
FIG. 3 is a face-on view of a drill bit in accordance according with various embodiments of the present disclosure.

FIG. 3 illustrates a drill bit 300 that may be similar to drill bit 200. For example, drill bit 300 may include primary blades 308*a*, 308*b*, 308*c*, which are formed in bit body 304 and extend from the face, with each blade 308 including a number of cutters 320 and/or load bearing elements. While shown with only primary blades 308, it will be appreciated that in addition or in place of primary blades 308 the drill bit may include one or more secondary blades. In the embodiment shown in FIG. 3, each of the plurality of blades 308*a*, 308*b*, 308*c* has a linear pattern (with a slight curvature), but each differs in orientation. For example, a first blade 308*a* may have a positive offset relative to central axis 302*a* to an outer edge of bit body 304. A second blade 308*b* has no offset and extends from non-central axis 302*b* to an outer edge of bit body 204. A third blade 308*c* has a positive offset and extends from central axis 302*c* to an outer edge of bit body 304. Notably, various combinations of blades may be employed together, and the disclosure is not limited to the specific configurations shown in the figures.

Figure 3A:
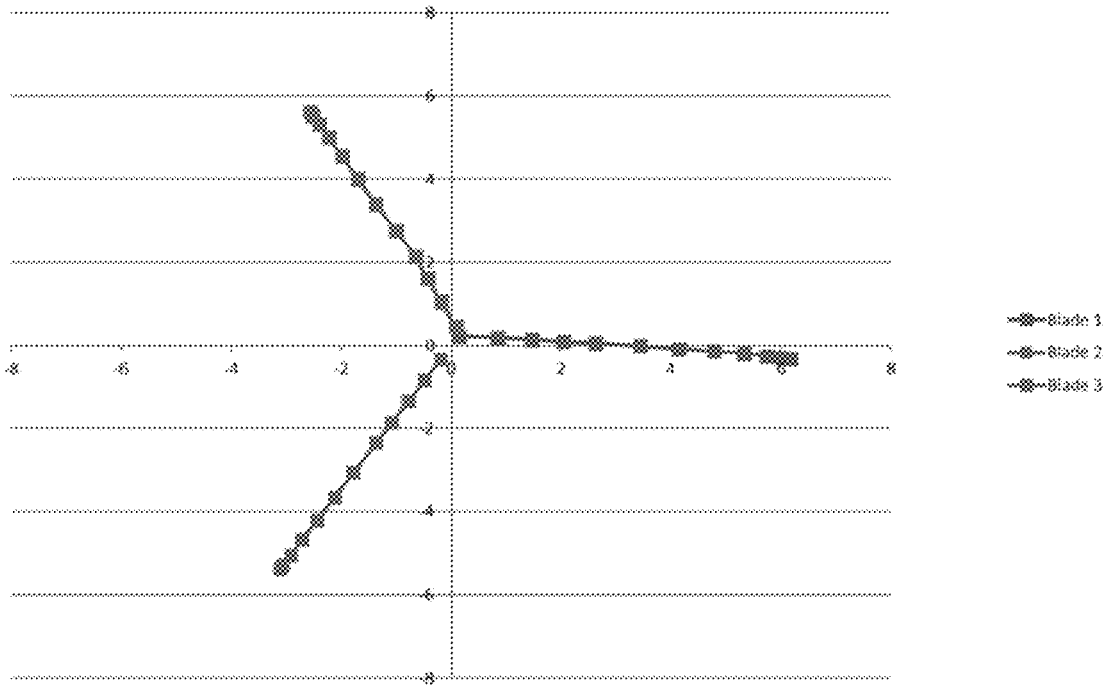
FIG. 3A is a graph showing cutter locations for the drill bit of FIG. 3.
Figure 3B:
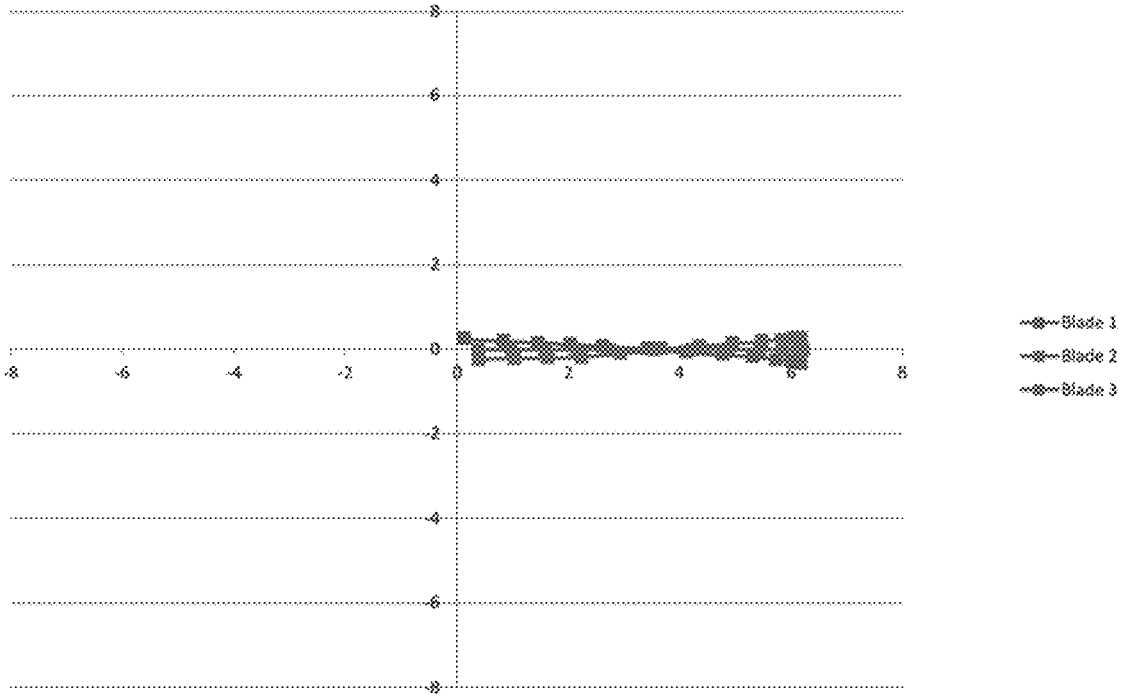
FIG. 3B is a graph showing cutter overlap for the drill bit of FIG. 3.

FIG. 3A is a graph illustrating the relative positioning the cutters 320 of drill bit 300. As shown in FIG. 3B, as the cutters 320 of each blade as rotated to a same angular position, only one cutter 320 (or other small subset of the cutters 320) from each blade 308 may overlap at a time. This may ensure that imperfections in the wellbore created by each blade will interact with surrounding blades gradually, rather than all at once. This may help smooth torque and reduce vibration.

Blades

The drill bits of the present disclosure comprise one or more blades. As illustrated in FIGS. 1, 1A, 2, and 3, the blades of the drill bit extend from the face of the bit body. The primary blades generally extend radially from an interior of the face (e.g., a point at or near the central axis of the drill bit) to the outer edge of the bit body. Each of the blades of the drill bit may be separated from one another by channels formed in the face of the bit body. The blades support the plurality of PDC cutters, which may be mounted along a leading edge and/or front face of the blade so as to define a cutting profile when the drill bit is rotated about its central axis. The channels may facilitate removal of the cuttings when a drilling fluid flows through the drill string, out openings in the face of the bit, through the channels and back up to the surface within an annular space formed between the drill string and side walls of the borehole.

The drill bit may comprise a plurality of blades, and the number of blades is not limited. In some embodiments, the drill bit may comprise at least one blade, e.g., at least two blades, at least three blades, or at least four blades. In one embodiment, for example, the drill bit comprises two blades, each of which differs from the other in shape and/or orientation. In another embodiment, the drill bit comprises three blades. It is contemplated, however, that some of the blades may be configured such that they do not differ (are the same) in terms of shape and/or orientation, so long as at least two of the blades do differ in shape or orientation from one another.

In some cases, in addition to or instead of the primary blades, the drill bit may comprise one or more secondary blades. In other words, some embodiments of the drill bit comprise the above-noted plurality of blades (which may be termed "primary" blades) as well as one or more secondary blades. The primary blades and the secondary blades typically differ in their length. Primary blades are generally defined as blades that extend radially from an interior of the face (e.g., a point at or near the central axis of the drill bit) to the outer edge of the bit body. Secondary blades are generally defined as blades that are spaced between the primary blades and that are radially distanced from the central axis of the drill bit. That is, the secondary blades typically begin a radial distance D from the central axis and extend to the outer edge. Both the primary blades and the secondary blades may support one or more PDC cutters. Notably, the term "blade," as used herein, without the adjectives "primary" or "secondary," refers to either of these types or even other types of blades.

In the drill bits of the present disclosure, the blades extending from the bit body may vary in terms of shape and/or orientation, as detailed below. In some cases, the shape and orientation of the blade are defined with respect to the blade in and of itself. For example, the shape of the blade may be defined by a leading edge of the blade. In some cases, the shape and orientation are defined with respect to a front line along which the cutting faces of the PDC cutters are aligned. For example, the plurality of PDC cutters supported by a first blade of the drill bit may be aligned along a first line extending from the interior of the bit face to the outer edge of the bit body. The shape and orientation detailed below may be referring to the shape and orientation of that first line (or the respective line on other blades).

Shape

Each blade of the drill bit may have any of a variety of shapes. In some cases, one or more blades of the drill bit may have a linear pattern. As used herein, the term "linear" is not limited to a perfectly straight line. Rather, a blade having a linear pattern may have a slight curvature or bend, so long as it does not have a waveform pattern.

In some cases, one or more blades of the drill bit have a curved pattern. As used herein, a curved pattern refers to any arcuate shape having more than a slight curve or bend. The shape of the curved pattern is not particularly limited. For example, the curved pattern may be a segment of a circle, ellipse, parabola, or any other rational, algebraic curve. In some embodiments, the curved pattern may have a degree of curvature from −90° to 90°, e.g., from −80° to 80°, from −70° to 70°, from −60° to 60°, from −50° to 50°, or from −45° to 45°.

In some cases, one or more blades of the drill bit have a waveform pattern. As used herein, a waveform pattern refers to a periodic varying shape. In some cases, for example, the waveform pattern may periodically vary in a generally sinusoidal, square, triangular, or sawtooth shape. It should be appreciated that a sinusoidal waveform pattern need not be shaped as a mathematically defined sine function; rather, a sinusoidal waveform pattern refers to a waveform pattern defined by smooth, periodic oscillation. In some embodiments, the waveform pattern may include at least one concave portion and at least one convex portion, however in some embodiments a waveform pattern may include only a single convex section or a single concave section. Similarly, a square waveform pattern need not be shaped as a perfect square; rather, a square waveform pattern refers to a waveform pattern defined by an amplitude that alternates at a steady frequency between fixed minimum and maximum values.

In some embodiments, the waveform pattern may extend entirely from an inner (radially) edge of the blade to an outer edge of the blade. In other embodiments, the waveform pattern may extend across only a portion of a length of the blade. For example, the waveform pattern may be provided on an inner 10% of the blade, an inner 15%, an inner 20%, an inner 25%, an inner 30%, an inner 35%, an inner 40%, an inner 45%, an inner 50%, an inner 55%, an inner 60%, an inner 65%, an inner 70%, an inner 75%, an inner 80%, an inner 85%, an inner 90%, an inner 95%, or more, while the remaining outer portion has a different pattern (such as linear and/or curved, In particular, in some embodiments the waveform pattern may be present on at least the cone and nose of the bit body, while all or a portion of the blade within the shoulder and/or gauge may have a different pattern.

In some embodiments, each blade on a given drill bit may have a waveform pattern. The waveform pattern on each blade may be out of phase with the rotationally adjacent blade. In some embodiments, the rotationally adjacent blade may refer to any blade on the drill bit (e.g., primary and/or secondary blade), while in other embodiments the rotationally adjacent blade may mean a rotationally adjacent blade within the cone of the drill bit (i.e., a rotationally adjacent primary blade). The adjacent blades may have a same amplitude, frequency, and/or wavelength, while having different phases. For example, as illustrated, a first blade (e.g., blade on the right side as illustrated) may start with a slope that approaches a trough of the waveform pattern, while a second blade (e.g., blade on the top side as illustrated) begins with a slope that approaches a peak of the waveform pattern, and a third blade (e.g., blade on the bottom left) has a slope that begins just after a trough of the waveform pattern. While shown with each blade having a waveform with a similar or same amplitude and wavelength, some drill bits may include blades that have waveforms of different amplitudes and/or wavelengths. In some embodiments, the amplitude, wavelength, and/or frequency of a single blade may vary across a length of the blade (i.e., as the radial distance from the central axis increases). For example, an amplitude of the waveform pattern may be greater at inner regions of the blade than at outer regions.

In some embodiments, the drill bit comprises a plurality of blades, and each blade has a different shape from the others. In some cases, the shape of the blades differ in that each blade has a different type of pattern. For example, the drill bit may comprise two blades: a first blade having a waveform pattern, and a second blade having a linear or curved pattern. In another example, the drill bit comprises three blades: a first blade having a waveform pattern, a second blade having a linear pattern, and a third blade having a curved pattern.

In some cases, the shapes of the blades differ despite overlapping types of patterns. In some embodiments, for example, the drill bit may comprise two blades: a first blade having a first waveform pattern, and a second blade having a second waveform pattern. The first and second waveform patterns may differ in that they have differing oscillating patterns. For example, the first waveform pattern may be sinusoidal, and the second waveform may be square. The differing oscillating patterns may differ, for example, in terms of one or more of amplitude, frequency or wavelength, as detailed below.

In some cases, the drill bit may comprise three or more blades with any combination of the above-described shapes. In one embodiment, for example, the drill bit comprises three blades, including a first waveform pattern, a second waveform pattern, and a linear pattern, respectively. In this embodiment, the first and second waveform pattern may have differing shapes. Of course, other combinations are also possible.

Orientation

In some embodiments, the plurality of blades on the drill bit may differ in terms of orientation. As used herein, the "orientation" of a blade refers to various aspects of the blade's position on the face of the bit body. In some cases, for example, two or more blades of the bit body may have the same (or generally the same) shape but may nevertheless differ in terms of orientation.

In some aspects, the orientation of the blade refers to the point from which the blade radially extends. As noted above, the blades of the drill extend from a point in the interior of the bit face to the outer edge of the bit body. The interior of the bit face, as used herein, refers to a circular region of the face defined by a radius that is one-third the total radius of the bit face. In some embodiments, one or more blades may extend from any point substantially near the central axis of the bit body. In some cases, for example, a blade may extend from the central axis of the bit body.

In some embodiments, one or more blades may extend from another point that is not at or near the central axis of the bit body but remains within the interior of the bit face. In some cases, this point may be a non-central axis of the drill bit. The non-central axis may be any other axis of the bit body. In some cases, the non-central axis may be an axis separate from but parallel to the central axis of the bit body. In this context, the term non-central axis refers to an imaginary line parallel to the central axis.

In some aspects, the orientation of the blade refers to the offset of the blade from the central axis. As used herein, the term "offset" refers to the perpendicular distance of a given blade's origin from the central axis of the blade bit. The offset of a blade may vary irrespective of the shape of the blade. Said another way, the following discussion of offsets its applicable to a blade having any shape according to the above description.

Figure 4:
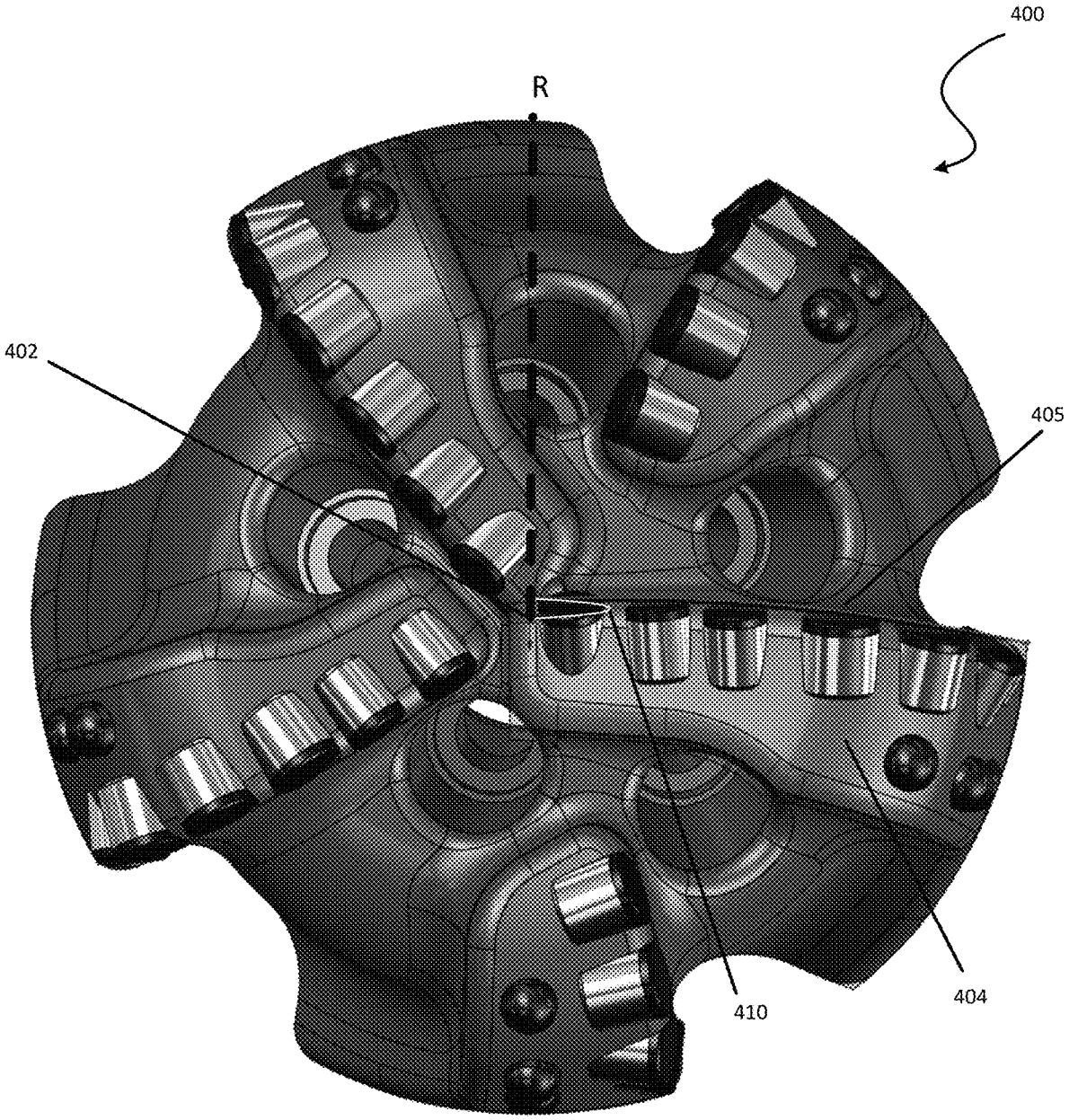
FIG. 4 is a face-on view of a drill bit in accordance according with various embodiments of the present disclosure, which is marked to indicate certain features of the drill bit.

Offset generally will be better understood with reference to FIG. 4, which shows the face of a drill bit 400. The drill bit 400 has a central axis 402 about which the drill bit 400 is designed to be rotated. As shown, drill bit 400 comprises a plurality of blades 404. A leading edge 405 of one blade 404 is shown in FIG. 4 to illustrate the amount of offset. In addition, FIG. 4 illustrates a radius R of the drill bit. As shown, blade 404 extends from a point on the radius R to the outer edge of drill bit 400. Offset 410 is the axial distance along the radius R between the leading edge 405 and the central axis 402 of the drill bit 400. In the embodiment shown in FIG. 4, the offset of the blade 404 is positive, which indicates that leading edge 405 of blade 404 is shifted forward (upward in the perspective of FIG. 4) from central axis 402. Conversely, a "negative offset," not shown, refers to a leading edge that is shifted backwards from the central axis.

The offset of a given blade of the drill bits described herein is not particularly limited. Any given blade may have a positive offset, a negative offset, or no offset at all.

In some embodiments, the (positive or negative) offset of a blade may range from 0" to 1", e.g., from 0" to 0.8", from 0" to 0.6", from 0" to 0.4", from 0.01" to 1", from 0.01" to 0.8", from 0.01" to 0.6", from 0.01" to 0.4", from 0.05" to 1", from 0.05" to 0.8", from 0.05" to 0.6", from 0.05" to 0.4", from 0.08" to 1", from 0.08" to 0.8", from 0.08" to 0.6", from 0.08" to 0.4", from 0.1" to 1", from 0.1" to 0.8", from 0.1" to 0.6", or from 0.1" to 0.4". In terms of upper limits, the offset may be less than 1", e.g., less than 0.8", less than 0.6", or less than 0.4". In terms of lower limits, the offset may be greater than 0", e.g., greater than 0.01", greater than 0.05", greater than 0.08", or greater than 0.1". In some cases, for example, the drill bit may comprise a blade having an offset of about 0.15".

In some embodiments, the ratio of the offset of a blade to the radius of the bit body may range from 0 to 0.5, e.g., from 0 to 0.4, from 0 to 0.3, from 0 to 0.2, from 0.01 to 0.1, from 0.01 to 0.5, from 0.01 to 0.4, from 0.01 to 0.3, from 0.01 to 0.2, from 0.01 to 0.1, from 0.02 to 0.1, from 0.02 to 0.5, from 0.02 to 0.4, from 0.02 to 0.3, from 0.02 to 0.2, from 0.02 to 0.1, from 0.03 to 0.1, from 0.03 to 0.5, from 0.03 to 0.4, from 0.03 to 0.3, from 0.03 to 0.2, from 0.03 to 0.1, from 0.04 to 0.1, from 0.04 to 0.5, from 0.04 to 0.4, from 0.04 to 0.3, from 0.04 to 0.2, from 0.04 to 0.1, from 0.05 to 0.1, from 0.05 to 0.5, from 0.05 to 0.4, from 0.05 to 0.3, from 0.05 to 0.2, or from 0.05 to 0.1. In terms of lower limits, the ratio of the offset of a blade to the radius of the bit body may be greater than 0, e.g., greater than 0.01, greater than 0.02, greater than 0.03, greater than 0.04, or greater than 0.05. In terms of upper limits, the ratio of the offset of a blade to the radius of the bit body may be less than 0.5, e.g., less than 0.4, less than 0.3, less than 0.2, or less than 0.1.

In some embodiments, two or more blades of the drill bit may differ with respect to offset. In some embodiments, for example, a first blade may have a positive offset, and a second blade may have a negative offset. In some embodiments, a first blade may have a positive offset, and a second blade may have no offset. In some embodiments, a first blade may have a negative offset, and a second blade may have no offset.

In some embodiments, blades of the drill bit may differ with respect to the size or degree of the offset. For example, a first blade may have a positive offset, and a second blade may have a larger positive offset. In another example, a first blade may have a positive offset, and a second blade may have a larger negative offset.

In some embodiments, the maximum difference in offset between two blades of the drill bit may range from −0.5" to 0.5", e.g., from −0.5" to 0.4", from −0.5" to 0.2", from −0.5" to 0.1", from −0.4" to 0.5", from −0.4" to 0.4", from −0.4" to 0.2", from −0.4" to 0.1", from −0.2" to 0.5", from −0.2" to 0.4", from −0.2" to 0.2", from −0.2" to 0.1", from −0.1" to 0.5", from −0.1" to 0.4", from −0.1" to 0.2", or from −0.1" to 0.1". In terms of upper limits, the maximum difference in offset between two blades of the drill bit may be less than 0.5", e.g., less than 0.4", less than 0.2", or less than 0.1". In terms of lower limits, the maximum difference in offset between two blades of the drill bit may be greater than −0.5", e.g., greater than −0.4", greater than −0.2", or greater than −0.1".

A drill bit having blades with any feasible combination of offsets is envisioned by the present disclosure. In one embodiment, for example, a drill bit may comprise five blades: a first blade having no offset, a second blade having a positive offset, a third blade having a larger positive offset (relative to the offset of the second blade), a fourth blade having a negative offset, and a fifth blade having a larger negative offset (relative to the offset of the fourth blade). Other embodiments of the drill bit may have fewer blades (e.g., three or four blades) with a similar combination of differing offsets.

In some aspects, the orientation of the blade refers to the metrics of a waveform pattern. As noted above, one or more blades of the drill bit may have a waveform pattern. In some embodiments, the drill bit comprises a first blade comprising a first waveform pattern and a second blade comprising a second waveform pattern, and the first waveform pattern and the second waveform pattern differ according to one or more of the metrics described herein.

The waveform pattern of a given blade may vary in terms of amplitude. The amplitude of the waveform pattern refers to the distance from a center line to the top of a crest (or bottom of a tough). The amplitude of the waveform pattern of a blade is not particularly limited. In some embodiments, the ratio of the radius of the bit body to the amplitude of a waveform pattern may range from 5 to 75, e.g., from 5 to 70, from 5 to 65, from 5 to 60, from 5 to 55, from 5 to 50, from 8 to 75, from 8 to 70, from 8 to 65, from 8 to 60, from 8 to 55, from 8 to 50, from 10 to 75, from 10 to 70, from 10 to 65, from 10 to 60, from 10 to 55, from 10 to 50, from 12 to 75, from 12 to 70, from 12 to 65, from 12 to 60, from 12 to 55, from 12 to 50, from 15 to 75, from 15 to 70, from 15 to 65, from 15 to 60, from 15 to 55, or from 15 to 50. In terms of lower limits, the ratio of the radius of the bit body to the amplitude of the waveform pattern may be greater than 5, e.g., greater than 8, greater than 10, greater than 12, or greater than 15. In terms of upper limits, the ratio of the radius of the bit body to the amplitude of the waveform pattern may be less than 75, e.g., less than 70, less than 65, less than 60, less than 55, or less than 50.

Additionally or alternatively, the waveform pattern of a given blade may vary in terms of wavelength. The wavelength of the waveform pattern refers to the length of one complete period of the wave. The wavelength of the waveform pattern of a blade is not particularly limited. In some embodiments, the ratio of the radius of the bit body to the wavelength of a waveform pattern may range from 0.5 to 50, e.g., from 0.5 to 49, from 0.5 to 48, from 0.5 to 47, from 0.5 to 46, from 0.5 to 45, from 0.6 to 50, from 0.6 to 49, from 0.6 to 48, from 0.6 to 47, from 0.6 to 46, from 0.6 to 45, from 0.7 to 50, from 0.7 to 49, from 0.7 to 48, from 0.7 to 47, from 0.7 to 46, from 0.7 to 45, from 0.8 to 50, from 0.8 to 49, from 0.8 to 48, from 0.8 to 47, from 0.8 to 46, from 0.8 to 45, from 0.9 to 50, from 0.9 to 49, from 0.9 to 48, from 0.9 to 47, from 0.9 to 46, or from 0.9 to 45. In terms of lower limits, the ratio of the radius of the bit body to the wavelength of the waveform pattern may be greater than 0.5, e.g., greater than 0.6, greater than 0.7, greater than 0.8, or greater than 0.9. In terms of upper limits, the ratio of the radius of the bit body to the wavelength of the waveform pattern may be less than 50, e.g., less than 49, less than 48, less than 47, less than 46, or less than 45.

Additionally or alternatively, the waveform pattern of a given blade may vary in terms of frequency. The frequency of the waveform pattern refers to the number of periods of the wave completed on the blade. The frequency of the waveform pattern of a blade is not particularly limited. In some embodiments, the frequency of the waveform pattern may range from 0.6 to 30, e.g., from 0.6 to 28, from 0.6 to 26, from 0.6 to 24, from 0.6 to 22, from 0.6 to 20, from 0.7 to 30, from 0.7 to 28, from 0.7 to 26, from 0.7 to 24, from 0.7 to 22, from 0.7 to 20, from 0.8 to 30, from 0.8 to 28, from 0.8 to 26, from 0.8 to 24, from 0.8 to 22, from 0.8 to 20, from 0.9 to 30, from 0.9 to 28, from 0.9 to 26, from 0.9 to 24, from 0.9 to 22, from 0.9 to 20, from 1 to 32, from 1 to 28, from 1 to 26, from 1 to 24, from 1 to 22, or from 1 to 20. In terms of lower limits, the ratio of the radius of the bit body to the wavelength of the waveform pattern may be greater than 0.6, e.g., greater than 0.7, greater than 0.8, greater than 0.9, or greater than 1. In terms of upper limits, the ratio of the radius of the bit body to the wavelength of the waveform pattern may be less than 30, e.g., less than 28, less than 26, less than 24, less than 22, or less than 20.

Additionally or alternatively, the waveform pattern of a given blade may vary in terms of phase. The phase of the waveform pattern refers to the location of a point within a single period of the waveform. For example, the waveform pattern of a given blade may begin at a crest of the waveform, a trough of the waveform, or any point therebetween. In some aspects, the phase may be defined with degrees as angular units, such that the waveform completes one full period in 360°. In this approach, the waveform is at the center line at 0°, 180°, and 360°, at its crest at 90°, and at its trough at 270°. When defined in this way, the waveform pattern of a given blade may begin (e.g., at a point at or near the central axis) at any phase from 0° to 360°.

In some embodiments, two or more blades of the drill bit may differ with respect to any one or more of the above wave metrics. In some embodiments, for example, a first blade may have a waveform pattern with a first, smaller amplitude, and a second blade may have a waveform pattern with a second, larger amplitude. In some embodiments, for example, a first blade may have a waveform pattern with a first, shorter wavelength, and a second blade may have a waveform pattern with a second, longer amplitude. In some embodiments, for example, a first blade may have a waveform pattern with a first, lower frequency, and a second blade may have a waveform pattern with a second, higher frequency.

A difference in phase between the waveform patterns of two blades may be characterized by phase shift. The phase shift refers to the difference between the phase at the beginning of two waveform patterns (e.g., the central axis or the non-central axis from which the blade extends). For example, if the waveform pattern of a first blade begins at a phase of 90°, and the waveform pattern of a second blade begins at a phase of 180°, the phase shift between the two is the difference, or 90°. When the phase shift is zero, the two signals are said to be in phase, otherwise they are out of phase with each other.

In some embodiments, the phase shift between the waveform of a first blade and the waveform of a second blade may be from 0° to 180°, e.g., from 0° to 165°, from 0° to 150°, from 0° to 135°, from 0° to 120°, from 15° to 180°, from 15° to 165°, from 15° to 150°, from 15° to 135°, from 15° to 120°, from 30° to 180°, from 30° to 165°, from 30° to 150°, from 30° to 135°, from 30° to 120°, from 45° to 180°, from 45° to 165°, from 45° to 150°, from 45° to 135°, from 45° to 120°, from 60° to 180°, from 60° to 165°, from 60° to 150°, from 60° to 135°, or from 60° to 120°. In terms of lower limits, the phase shift may be greater than 0°, e.g., greater than 15°, greater than 30°, greater than 45°, or greater than 60°. In terms of upper limits, the phase shift may be less than 180°, e.g., less than 165°, less than 150°, less than 135°, or less than 120°.

A drill bit having blades with waveform patterns that differ based on variation in any one or more above wave metric is envisioned by the present disclosure. In one embodiment, for example, a drill bit may comprise five blades, each with a unique waveform pattern: the first blade may have a sinusoidal waveform pattern, the waveform pattern of the second blade may have a smaller amplitude (relative to the first blade), the waveform pattern of the third blade may have a longer wavelength (relative to the first blade), the waveform pattern of the fourth blade may have a phase shift of 90° (relative to the first blade), and the waveform pattern of the fifth blade may have a phase shift of 180° (relative to the first blade). Other embodiments of the drill bit may have fewer blades (e.g., three or four blades) with a similar combination of differing offsets.

Methods and Systems of Using Drill Bit

In same aspects, the present disclosure also relates to methods and systems for using the novel drill bits described herein. In particular, some embodiments of the present disclosure relate to the use of a drill bit (according to the above description) in advancing a borehole through rock.

Figure 5:
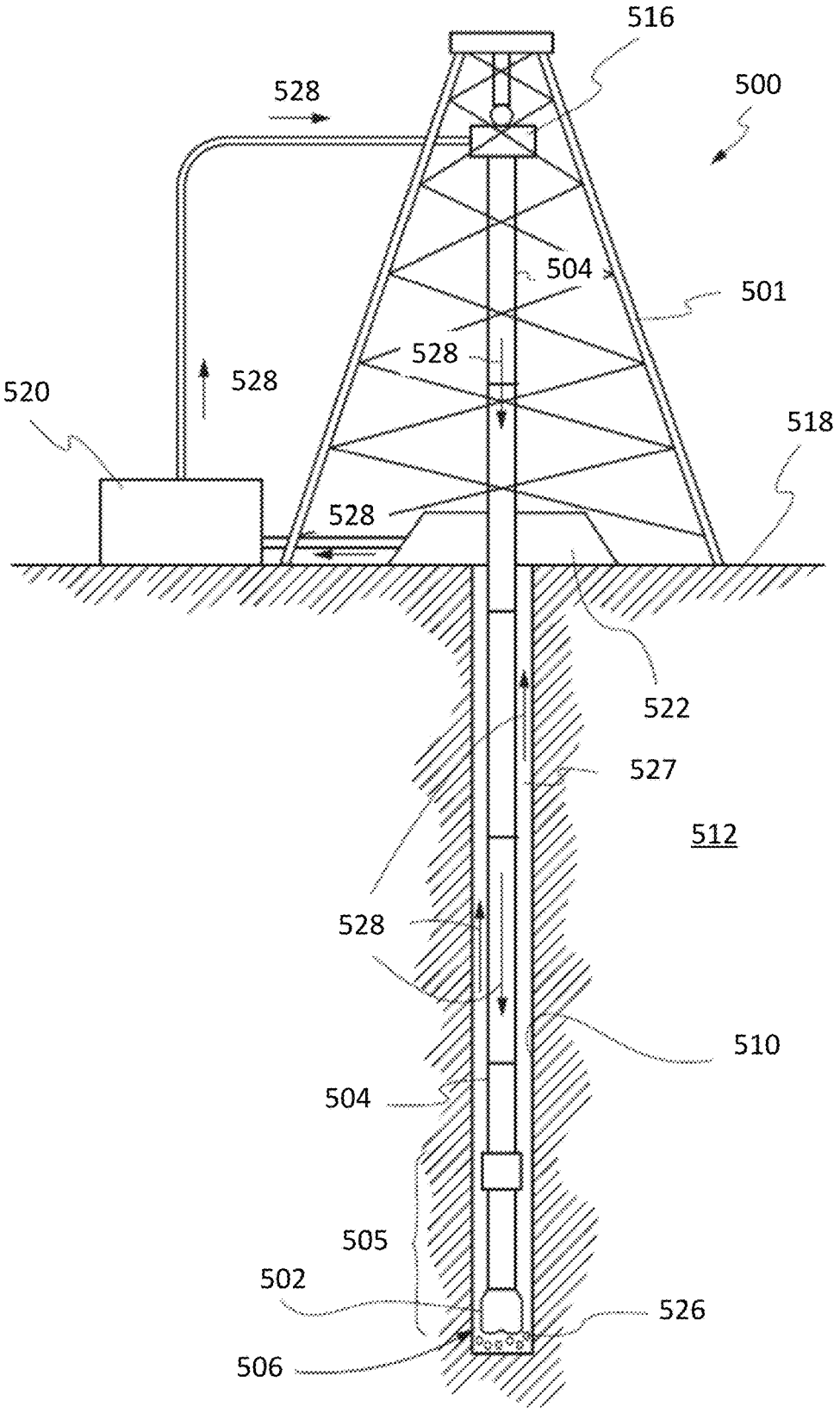
FIG. 5 is a schematic view of a downhole drilling operation in accordance with various embodiments.

FIG. 5 is a schematic representation of a drilling rig 500 for a drilling operation. Each of the components that are shown in the schematic representation of the drilling rig 500 are intended to be generally representative of the component, and the particular example is intended to be a non-limiting, representative example of how a drilling rig might be set up for drilling with a drill bit as described herein. In various embodiments, the drilling rig 500 includes a derrick 501 that positions a drill bit 502 at the end of a drill string 504 within the hole or well bore 506 that is formed in the subterranean formation 512. During drilling operations, a drill bit 502 may be coupled to a lower end of the drill string 504.

Drill string 504 may be several miles long and, like the well bore 506, extend in both vertical and horizontal directions from the surface 518. In the illustrated embodiment, the drill string 504 is formed of segments of threaded pipe that are screwed together at the surface as the drill string 504 is lowered into the well bore 506. However, the drill string 504 may also comprise coiled tubing. The drill string 504 may also include components other than pipe or tubing. For example, a bottom hole assembly (BHA) 505 may be coupled to a lower end of the drill string 504 prior to the drill bit 502. The BHA 505 may include, depending on the particular application, one or more of the following components: a bit sub, a downhole motor, stabilizers, drill collar, jarring devices, directional drilling and measuring equipment, measurements-while-drilling tools, logging-while-drilling tools and other devices. The characteristics of the components of the BHA 505 contribute to determining the drilling penetration rate of the drill bit 502 and the well bore 506 shape, direction and other geometric characteristics.

During drilling, the drill bit 502 is rotated to shear the subterranean formation 512 and advance the well bore 506. The drill bit 502 may be rotated in any number of ways. For example, the drill bit 502 may be rotated by rotating the drill string 504 with a top drive 516 or a table drive (not shown) or with a downhole motor that is part of the BHA 505. The drill bit 502 may be surrounded by a sidewall 510 of the well bore 506. As the drill bit 502 is rotated within the well bore 506 via the drill string 504, a drilling fluid may be pumped down the drill string 504, through the internal passageways within the drill bit 502, and out from drill bit 502 through openings, nozzles or ports. Formation cuttings 526 generated by the one or more PDC cutters of the drill bit 502 may be carried with the drilling fluid through the channels, around the drill bit 502, and back up the well bore 506 through the annular space 527 within the well bore 506 outside the drill string 504.

The drilling fluid may be pumped down the drill string 504 using conventional means, e.g., pumps. FIG. 5 illustrates a fluid source 520, which is intended to be a non-limiting representation of any of the possible ways of generating the drilling fluid (e.g., hydraulic or pneumatic fluid), as the drill bit 502 can be used with any of them. The drilling fluid is circulated down the well bore 506 by flowing it through the drill string 504, to the drill bit 502, where it exits through the openings, nozzles or ports to carry cuttings away from the face of the drill bit 502 and into the annular space 527, where the cuttings may be carried up to a collection point 522. The drilling fluid within the collection point 522 may be recirculated once cleaned of the cuttings.

In various embodiments, the drilling fluid comprises liquid drilling mud. Various conventional liquid drilling muds are known, and each of these is acceptable for use with the drill bits and the drilling system described herein. In some embodiments, for example, the liquid drilling mud may comprise water alone or in combination with other components. In some embodiments, the liquid drilling mud may comprise water in combination with clays (e.g., betonite) or other chemicals (e.g., potassium formate). In some embodiments, the liquid drilling mud may be an oil-based mixture, for example, comprising a petroleum product. In some embodiments, the liquid drilling mud may comprise a synthetic oil A drilling fluid, such as drilling mud or a pneumatic fluid, may be pumped down the drill string, into a central passageway formed in the center of the bit, and then out through openings formed in the face of the bit. Drilling fluid can serve many purposes. For example, the drilling fluid may be used to cool, lubricate, or otherwise the cutters or other components of the drill string, to remove and carry cuttings from the well, to suspend and release cuttings, to seal formations, to transmit hydraulic energy to the tools, to convey measurements to the surface, to control corrosion, and/or to facilitate cementing.

EMBODIMENTS

As used below, any reference to a series of embodiments is to be understood as a reference to each of those embodiments disjunctively (e.g., "Embodiments 1-4" is to be understood as "Embodiments 1, 2, 3, or 4").

Embodiment 1 is a drill bit to advance a borehole, comprising: a bit body comprising a central axis about which the drill bit is intended to rotate and a first blade extending from the face, the first blade having a first waveform pattern defined from about the central axis to an outer edge of the bit body; and a plurality polycrystalline diamond compact ("PDC") cutters on the first blade.

Embodiment 2 is the drill bit of embodiment(s) 1, wherein the first waveform pattern has a sinusoidal shape.

Embodiment 3 is the drill bit of embodiment(s) 1-2, wherein the bit body further comprises a second blade extending from the face, and wherein the first blade and the second blade are separated by a channel.

Embodiment 4 is the drill bit of embodiment(s) 3, wherein the first blade and the second blade are rotationally adjacent.

Embodiment 5 is the drill bit of embodiment(s) 3-4, wherein the second blade has a linear pattern defined from about the central axis to the outer edge.

Embodiment 6 is the drill bit of embodiment(s) 3-4, wherein the second blade has a curved pattern defined from about the central axis to the outer edge.

Embodiment 7 is the drill bit of embodiment(s) 3-4, wherein the second blade has a second waveform pattern defined from about the central axis to the outer edge.

Embodiment 8 is the drill bit of embodiment(s) 7, wherein the first waveform pattern and the second waveform pattern have a differing shape, amplitude, frequency, and/or phase.

Embodiment 9 is the drill bit of embodiment(s) 7-8, wherein the first waveform pattern and the second waveform pattern are at least partially out of phase.

Embodiment 10 is the drill bit of embodiment(s) 7-9, wherein the first waveform pattern and the second waveform pattern exhibit a phase shift of from 0° to 180°.

Embodiment 11 is a drill bit to advance a borehole, comprising: a bit body having a central axis about which the drill bit is intended to rotate and a face on which is defined a plurality of blades the face and separated by channels between the blades; and a plurality of PDC cutters on the plurality of blades; wherein the pattern of each blade differs from the other blades in shape or orientation.

Embodiment 12 is the drill bit of embodiment(s) 11, wherein a first blade of the plurality of blades has a pattern selected from the group consisting of a linear pattern, a curved pattern, and a waveform pattern.

Embodiment 13 is the drill bit of embodiment(s) 12, wherein a second blade of the plurality of blades has a pattern selected from the group consisting of a linear pattern, a curved pattern, and a waveform pattern, wherein the first blade and the second blade have differing patterns.

Embodiment 14 is the drill bit of embodiment(s) 11-13, wherein a first blade of the plurality of blades has a first waveform pattern defined from the central axis to an outer edge of the bit body.

Embodiment 15 is the drill bit of embodiment(s) 14, wherein a second blade of the plurality of blades has a second waveform pattern defined from a non-central axis of the bit body to the outer edge.

Embodiment 16 is the drill bit of embodiment(s) 14, wherein a second blade of the plurality of blades has a second waveform pattern defined from the central axis of the bit body to the outer edge, and wherein the first waveform pattern and the second waveform pattern have a differing shape, amplitude, frequency, and/or phase.

Embodiment 17 is the drill bit of embodiment(s) 11-16, wherein a first blade of the plurality of blades has a linear pattern defined from the central axis to an outer edge of the bit body, and wherein a second blade of the plurality of blades has a linear pattern defined from a non-central axis of the bit body to the outer edge.

Embodiment 18 is the drill bit of embodiment(s) 11-16, wherein a first blade of the plurality of blades has a linear pattern defined from the central axis to an outer edge of the bit body, and wherein a second blade of the plurality of blades has a curved pattern defined from the central axis to the outer edge.

Embodiment 19 is the drill bit of embodiment(s) 11-16, wherein a first blade of the plurality of blades has a curved pattern defined from the central axis to an outer edge of the bit body, and wherein a second blade of the plurality of blades has a curved pattern defined from a non-central axis to the outer edge.

Embodiment 20 is a drill bit to advance a borehole, comprising: a bit body having a central axis about which the drill bit is intended to rotate and a face; a first blade disposed at least in part on the face and extending from the central axis to an outer edge of the bit body; a second blade disposed at least in part on the face and extending from a first non-central axis to the outer edge, the first blade and the second blade being separated by a first channel; and a plurality of PDC cutters on each of the first blade and the second blade.

Embodiment 21 is the drill bit of embodiment(s) 20, wherein the first blade has a pattern selected from the group consisting of a linear pattern, a curved pattern, and a waveform pattern.

Embodiment 22 is the drill bit of embodiment(s) 20-21, wherein the first blade has a linear pattern.

Embodiment 23 is the drill bit of embodiment(s) 20-22, wherein the second blade has a pattern selected from the group consisting of a linear pattern, a curved pattern, and a waveform pattern.

Embodiment 24 is the drill bit of embodiment(s) 20-23, wherein the second blade has a linear pattern.

Embodiment 25 is the drill bit of embodiment(s) 20-24, further comprising a third blade disposed at least in part on the face and extending from a second non-central axis to the outer edge.

Embodiment 26 is the drill bit of embodiment(s) 25, wherein the third blade has a pattern selected from the group consisting of a linear pattern, a curved pattern, and a waveform pattern.

Embodiment 27 is the drill bit of embodiment(s) 25-26, wherein the third blade has a linear pattern.

Embodiment 28 is a drill bit comprising: a bit body having a central axis about which the drill bit is intended to rotate, a first blade, and second blade, the first blade and the second blade being separated by a channel; a first plurality of PDC cutters supported by the first blade, the first plurality of PDC cutters being aligned along a first line extending from a first axis of the bit body; and a second plurality of PDC cutters supported by the second blade, the second plurality of PDC cutters being aligned along a second line extending from a second axis of the bit body.

Embodiment 29 is the drill bit of embodiment(s) 28, wherein the first line is linear, curved along an arc, or waveform.

Embodiment 30 is the drill bit of embodiment(s) 28-29, wherein the second line is linear, curved along an arc, or waveform.

Embodiment 31 is the drill bit of embodiment(s) 28-30, wherein the first line and the second line are differently shaped or oriented.

Embodiment 32 is the drill bit of embodiment(s) 28-31, wherein the first axis and the second axis are a central axis about which the drill bit is intended to rotate, and wherein the first line and the second line have a differing shape.

Embodiment 33 is the drill bit of embodiment(s) 28-32, wherein the first axis is a central axis about which the drill bit is intended to rotate, wherein the second axis is a non-central axis, and wherein the first line and the second line are superimposable.

Embodiment 34 is the drill bit of embodiment(s) 33, wherein the first axis is parallel to the second axis.

Embodiment 35 is a drill bit comprising: a bit body having a first blade and second blade, the first blade and the second blade being separated by a channel; a first plurality of PDC cutters supported by the first blade, the first plurality of PDC cutters being aligned along a first line having a positive offset from the central axis; and a second plurality of PDC cutters supported by the second blade, the second plurality of PDC cutters being aligned along a second line having a negative offset from the central axis.

Embodiment 36 is a method of advancing a borehole through rock with a drill bit, the drill bit comprising a bit body having a central axis about which the drill bit is intended to rotate and a face on which is defined a plurality of blades extending from the face and separated by channels between the blades, and a plurality of PDC cutters on the plurality of blades, wherein the pattern of each blade from the other blades in shape or orientation, the method comprising: rotating the drill bit about the central axis within the borehole to cause the plurality of PDC cutters to shear the rock.

I claim:

1. A drill bit to advance a borehole, comprising:

a bit body comprising a central axis about which the drill bit is intended to rotate and a plurality of blades, the plurality of blades comprising a first blade and a second blade; and a plurality polycrystalline diamond compact ("PDC") cutters on each of the plurality of blades, wherein:

the plurality of PDC cutters comprise cutter pairs, with a first cutter of each cutter pair being disposed on the first blade and a radially corresponding second cutter of each cutter pair being disposed on the second blade;

the cutter pairs are arranged on the first blade and the second blade with an angular distance between the first cutter and the radially corresponding second cutter being different for at least some of the cutter pairs such that when the drill bit is rotated within a borehole, a time lag between when the first cutter and the radially corresponding second cutter engage a formation is different for the at least some of the cutter pairs.

2. The drill bit of claim 1, wherein the PDC cutters on the first blade forms a sinusoidal shape having at least one concave region and at least one convex region.

3. The drill bit of claim 1, wherein the first blade and the second blade are separated by a channel.

4. The drill bit of claim 3, wherein the first blade and the second blade are rotationally adjacent.

5. The drill bit of claim 3, wherein the second blade has a linear pattern defined from about the central axis to an outer edge of the second blade.

6. The drill bit of claim 3, wherein the second blade has a curved pattern defined by a single curve extending from about the central axis to an outer edge of the second blade.

7. The drill bit of claim 3, wherein the first blade has a first waveform pattern defined from about the central axis to an outer edge of the first blade, wherein the second blade has a second waveform pattern defined from about the central axis to an outer edge of the second blade, and wherein each of the first waveform pattern and the second waveform pattern comprises at least one concave region and at least one convex region.

8. The drill bit of claim 7, wherein the first waveform pattern and the second waveform pattern have at least differing characteristic selected from a shape, an amplitude, a frequency, and a phase.

9. The drill bit of claim 7, wherein the first waveform pattern and the second waveform pattern are at least partially out of phase.

10. The drill bit of claim 7, wherein the first waveform pattern and the second waveform pattern exhibit a phase shift of from 0° to 180° relative to one another.

11. A drill bit to advance a borehole, comprising:

a bit body having a central axis about which the drill bit is intended to rotate and a face on which is defined a plurality of blades that are separated by channels formed between the blades, the plurality of blades comprising a first blade and a second blade; and a plurality of PDC cutters on the plurality of blades, wherein:

the plurality of PDC cutters comprise cutter pairs, with a first cutter of each cutter pair being disposed on the first blade and a radially corresponding second cutter of each cutter pair being disposed on the second blade; and the cutter pairs are arranged on the first blade and the second blade with an angular distance between the first cutter and the radially corresponding second cutter being different for at least some of the cutter pairs the such that when the drill bit is rotated within a borehole, a time lag between when the first cutter and the radially corresponding second cutter engage a formation is different for the at least some of the cutter pairs.

12. The drill bit of claim 11, wherein the first blade has a pattern selected from the group consisting of a linear pattern, a curved pattern defined by a single curve, and a waveform pattern comprising at least one convex region and at least one concave region.

13. The drill bit of claim 12, wherein the second blade has a pattern selected from the group consisting of a linear pattern, a curved pattern defined by a single curve, and a waveform pattern comprising at least one convex region and at least one concave region, wherein the first blade and the second blade have differing patterns.

14. The drill bit of claim 11, wherein the first blade of the plurality of blades has a first waveform pattern defined from the central axis to an outer edge of the bit body, the first waveform pattern comprising at least one convex region and at least one concave region.

15. The drill bit of claim 14, wherein the second blade of the plurality of blades has a second waveform pattern defined from a non-central axis of the bit body to the outer edge, the second waveform pattern comprising at least one convex region and at least one concave region.

16. The drill bit of claim 14, wherein the second blade of the plurality of blades has a second waveform pattern defined from the central axis of the bit body to the outer edge, the second waveform pattern comprising at least one convex region and at least one concave region, and wherein the first waveform pattern and the second waveform pattern have a differing shape, amplitude, frequency, and/or phase.

17. The drill bit of claim 11, wherein the first blade of the plurality of blades has a linear pattern defined from the central axis to an outer edge of the bit body, and wherein the second blade of the plurality of blades has a linear pattern defined from a non-central axis of the bit body to the outer edge, wherein each linear pattern comprises a straight line.

18. The drill bit of claim 11, wherein the first blade of the plurality of blades has a linear pattern defined by a single curve extending from the central axis to an outer edge of the bit body, and wherein the second blade of the plurality of blades has a curved pattern defined by a single curve extending from the central axis to the outer edge.

19. The drill bit of claim 11, wherein the first blade of the plurality of blades has a curved pattern defined by a single curve extending from the central axis to an outer edge of the bit body, and wherein the second blade of the plurality of blades has a curved pattern defined by a single curve extending from a non-central axis to the outer edge.

20. A drill bit to advance a borehole, comprising:

a bit body having a central axis about which the drill bit is intended to rotate and a face;

a first blade disposed at least in part on the face and extending from the central axis to an outer edge of the bit body;

a second blade disposed at least in part on the face and extending from a first non-central axis to the outer edge, the first blade and the second blade being separated by a first channel; and a plurality of PDC cutters on each of the first blade and the second blade, wherein:

the plurality of PDC cutters comprise cutter pairs, with a first cutter of each cutter pair being disposed on the first blade and a radially corresponding second cutter of each cutter pair being disposed on the second blade; and the cutter pairs are arranged on the first blade and the second blade with an angular distance between the first cutter and the radially corresponding second cutter being different for at least some of the cutter pairs such that when the drill bit is rotated within a borehole, a time lag between when the first cutter and the radially corresponding second cutter engage a formation is different for the at least some of the cutter pairs.

* * * * *